US006739371B2

(12) United States Patent
Mukai

(10) Patent No.: US 6,739,371 B2
(45) Date of Patent: May 25, 2004

(54) AWNING INSTALLATION DEVICE

(76) Inventor: Hiroo Mukai, 9-22-201, Oakashi-cho 1-chome, Akashi (JP), 673-0891

( * ) Notice: Subject to any disclaimer, the term of this patent is extended or adjusted under 35 U.S.C. 154(b) by 169 days.

(21) Appl. No.: 10/198,294

(22) Filed: Jul. 18, 2002

(65) Prior Publication Data

US 2003/0192649 A1 Oct. 16, 2003

(30) Foreign Application Priority Data

Apr. 15, 2002 (JP) ..... 2002-111856

(51) Int. Cl.[7] ..... E04F 10/06
(52) U.S. Cl. ..... 160/22; 160/66; 248/273
(58) Field of Search ..... 160/22, 66, 67, 160/70, 79, 83.1, 903, DIG. 5; 135/88.11, 88.12; 248/273

(56) References Cited

U.S. PATENT DOCUMENTS 3,991,805 A * 11/1976 Clauss ..... 160/22
4,673,017 A * 6/1987 Lauzier ..... 160/22
5,394,921 A * 3/1995 Lohausen ..... 160/22
5,427,168 A * 6/1995 Lohausen ..... 160/22
5,560,411 A * 10/1996 Becker ..... 135/88.12
6,024,152 A * 2/2000 Rosenich ..... 160/66 X

* cited by examiner

*Primary Examiner*—David Purol
(74) *Attorney, Agent, or Firm*—Duane Morris LLP

(57) ABSTRACT

An awning installing device includes a main body having first and second opposing major surfaces, and has a given width and appropriate thickness and length. The first major surface is adapted to be brought into contact with a façade wall onto which an awning is to be installed, and the awning is to be mounted on the second major surface. A groove is formed in the main body to open at the second major surface and extend along the entire length of the main body. A bracket for supporting the awning has a portion which is movable in and along the groove to a desired location where it can be fixed. The main body is provided with a plurality of securing holes. Screws can be screwed through selected ones of the securing holes into the wall for securing the main body. End securing members which close the both ends of the groove are used to secure the ends of the main body to walls extending perpendicularly to the façade wall.

11 Claims, 10 Drawing Sheets

AWNING INSTALLATION DEVICE

This invention relates to a device for installing an awning having a sunshade sheet or canvas at a desired location.

BACKGROUND OF THE INVENTION

FIG. 1 is a schematic side, partially cross-sectional view of an example of an awning. As is seen also from a perspective view shown in FIG. 2, the awning 1 includes a sunshade sheet 2 of cloth or vinyl, for example. (For ease of illustration of components beneath it, the sheet 2 is shown in FIG. 2 as being transparent, but it should be understood that the sheet 2 should be opaque or be able to shade things under the awning.) The sunshade sheet 2 can be rolled on a shaft 3, which is rotatably supported at its opposite ends by bearings 4. The bearings 4 are secured to a pair of end brackets 5, which, in turn, are secured to a rectangular or square shaft 6 having a rectangular or square cross-section. The rectangular shaft 6 is supported by a pair of brackets 7. Each of the brackets 7 is secured to a wall 8 with anchor bolts 9 and 9'. A front bar 11 is secured to the rectangular shaft 6 via arms 10. The front edge portion of the sunshade sheet 2 is secured to the front bar 11.

When the awning 1 is not used, the sunshade sheet 2 is rolled up around the shaft 3. In this state, the front bar 11 is located close to the shaft 3, and the arms 10 are bent, so that the sunshade sheet 2, the front bar 11 and the arms 10 can be retracted beneath a roof 12 of the awning 1, as shown in FIG. 1.

In order to use the awning 1, a front end of a crank handle (not shown) is engaged with a ring 13 operationally associated with the shaft 3 to rotate the ring 13 in a given direction by a given number of rotations so as to rotate the shaft 3 in the clockwise direction in FIG. 1. This causes the front bar 11 to move away from the shaft 3 so that the sunshade sheet 2 can be spread to a desired extent. In FIG. 1, reference numerals 14 and 15 denote bolts for securing the awning 1 to the brackets 7, and a reference numeral 16 denotes one of L-shaped arms which support the awning roof When the sunshade sheet 2 is spread, a strong wind may exert a large force to the awning 1. Therefore, the awning 1 must be secured firmly to the wall 8 with the brackets 7 and the anchor bolts 9 and 9', as shown in FIG. 1.

However, it is sometimes difficult or impossible to secure one or both of the brackets 7 to the wall 8 at proper location to provide the awning 1 with sufficient resistance to a strong wind or force acting on it, so that the awning 1 cannot be installed at a desired location.

The brackets 7 for supporting the awning 1 must be secured to proper positions on the awning installation wall 8 in such a manner as to support proper portions of the awning 1, for example, portions in the vicinity of its two opposing ends. Accordingly, when the awning 1 is to be installed at a desired location on the wall 8, support members, for example, pillars to which the brackets 7 are secured so that they can be firmly supported must be present at the locations on the wall 8 corresponding to the locations of the brackets 7 on the awning 1. If there are not such support members on the wall 8, the awning 1 cannot be installed at the desired location. Therefore, an object of the present invention is to provide an awning installing device enabling the firm installation of an awning at a desired location.

SUMMARY OF THE INVENTION

An awning installing device according to the present invention includes a generally plate-shaped main body having a predetermined width, a length and a thickness. A first one of the major surfaces of the main body is adapted to face and be secured to a structure to which an awning is to be installed, and the other, second major surface is adapted to support the awning secured to it. The main body includes a guide extending along the entire length thereof. The awning installing device also has a bracket having a guided portion to be guided by the guide on the main body so that the bracket can be moved along the guide and can be secured to the main body at a desired location along the guide.

For installing the awning with the installing device according to the invention, to a wall by means of, for example, pillars and/or vertical bars in the wall, the main body of the installing device is placed in such a position that the bracket can be secured to the structure at a desired location. The main body is horizontally elongated and, therefore, crosses one or more pillars and/or vertical bars. The main body is firmly secured to appropriate ones of the pillars and/or vertical bars by fixing means, e.g. anchor bolts or screws. Then, the bracket is moved along the length of the main body to the desired location and secured to the main body at that location. After that, the awning is mounted to the bracket.

Since the bracket can be moved along the length of the main body which is firmly secured to the wall of the structure, a desired location where the bracket, and, therefore, the awning, is to be secured relative to the wall can be selected. Since the main body of the awning installing device is firmly secured to the pillars and/or vertical bars in the wall, the awning is also firmly held and secured.

The guide may be in the form of a longitudinally extending groove. In this case, the guided portion of the bracket may be formed as an engaging portion which is located in the groove and in engagement with the groove so as to endure load acting on the bracket.

The main body may be provided with a number of holes extending through the entire thickness of the main body, which can be selectively used for securing the main body to the pillars and/or vertical bars by means of anchor bolts, screws or the like.

The groove may be formed to open in the second major surface. The engaging portion may be formed as an engagement member, as a member separate from the bracket. A male screw is screwed to extend through the bracket toward the main body into the groove opening. The male screw is tightened so that the engagement member and the bracket can be firmly secured to the main body. By loosening the screw to an appropriate extent, the bracket with the engagement member and the male screw can be moved along the groove to any desired location, where they can be firmly secured by tightening the screw.

The awning installing device may be provided with an end securing member. The end securing member includes a plate-like portion having a protrusion on one of its major surfaces, which is adapted to fit into the groove in the main body from the opening of the groove opening in one end surface of the main body. The end securing member includes also a coupling portion extending from the plate-like portion beyond the first or second major surface of the main body. The coupling portion is used to secure the plate-like portion to a wall surface extending generally perpendicular, in either direction, to the wall to which the main body is to be secured.

BRIEF DESCRIPTION OF THE DRAWINGS

FIGS. 7A, 7B, 7C and 7D show another form of the end securing member shown in FIGS. 5A, 5B and 5C, which is formed of two parts, in which FIGS. 7A and 7B are front and right side views of an upper part of the member, and FIGS. 7C and 7D are front and right side views of a lower part of the member;

FIGS. 8A, 8B, 8C and 8D show another form of the end securing member shown in FIGS. 6A, 6B and 6C, which is formed of two parts, in which FIGS. 8A and 8B are front and left side views of an upper part of the member, and FIGS. 8C and 8D are front and left side views of a lower part of the member;

FIGS. 10A and 10B show an awning installing device according to another embodiment of the present invention, in which FIG. 10A is a left side view of the device and FIG. 10B is a front view of part of the device; and FIGS. 11A, 11B and 11C show an example of a groove engagement member which may be used in the awning installing device shown in FIGS. 10A and 10B, in which FIGS. 11A and 11B are plan and front views of the member, and FIG. 11C is a cross-sectional view along a line 11C—11C in FIG. 11B.

DETAILED DESCRIPTION OF THE INVENTION

Figure 1:
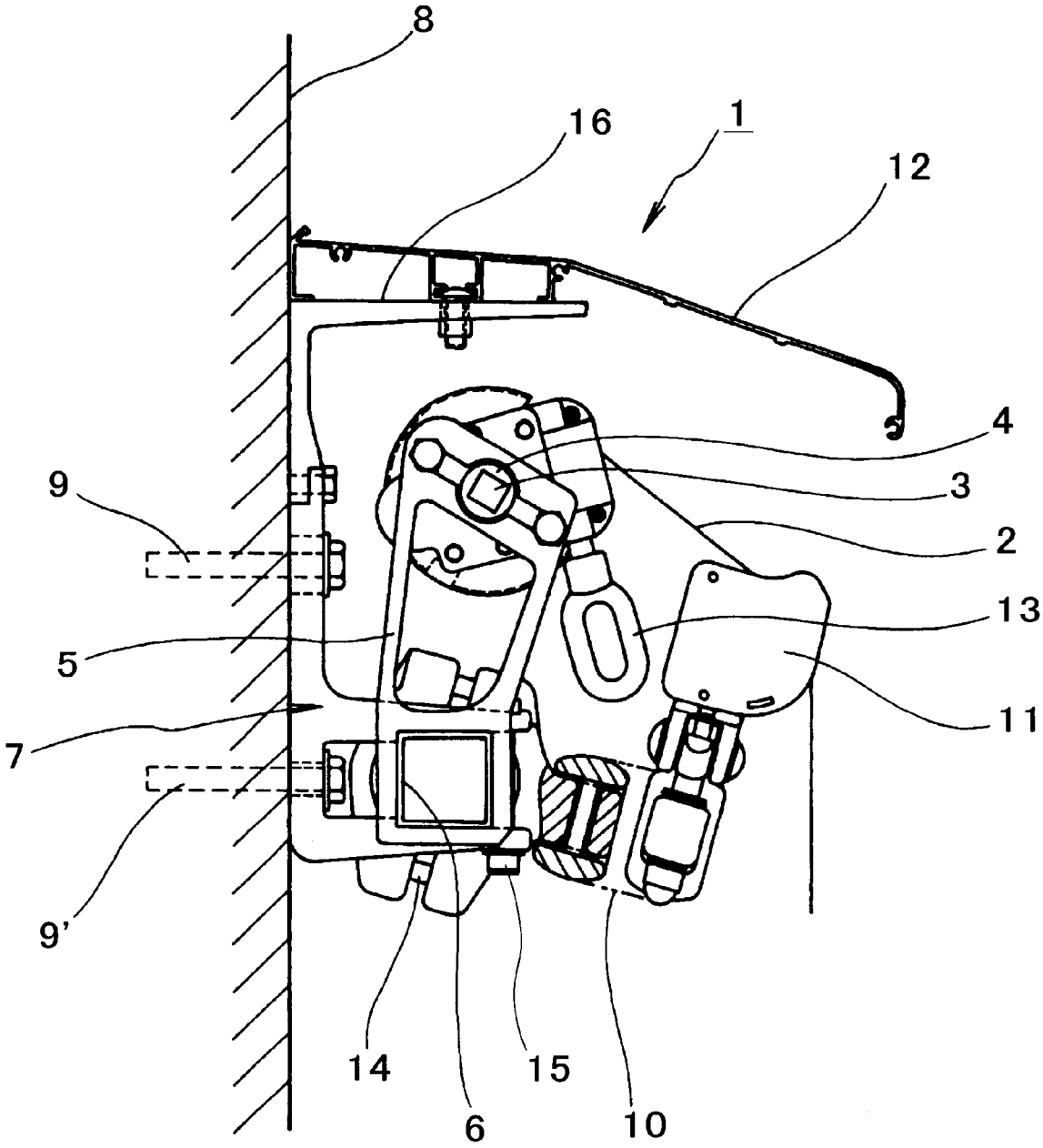
FIG. 1 Prior Art
FIG. 1 is a schematic left side view of a prior art awning installing device.

Now, one embodiment of the present invention is described with reference to FIGS. 2 through 9. An awning installing device 20 according to this embodiment includes a main body 21 made of metal, two brackets 22, and end securing members 23 and 24.

Figure 2:
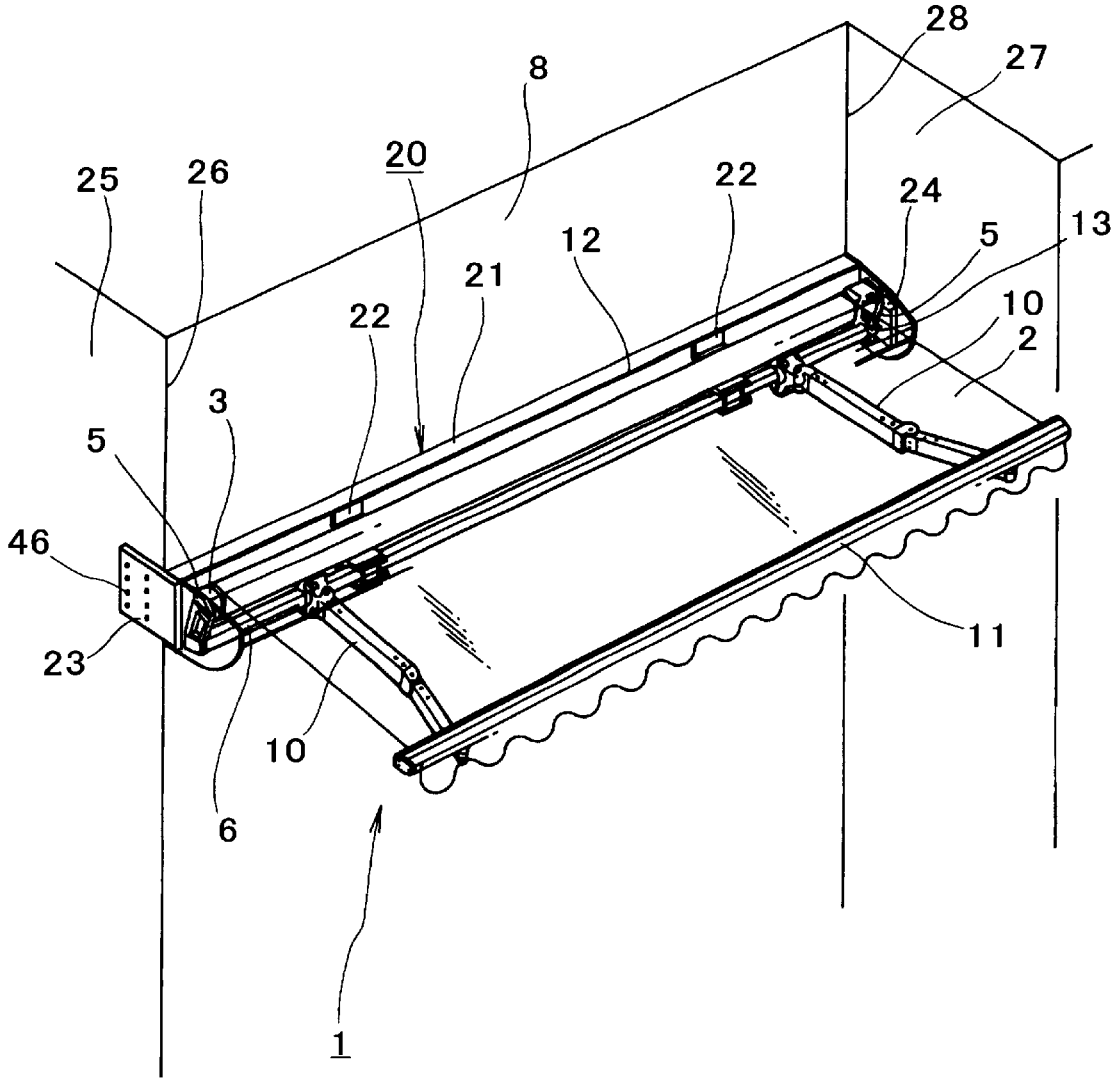
FIG. 2 is a schematic perspective view of an awning installed onto a structure with an awning installing device according to a first embodiment of the present invention.

As shown in FIG. 2, the installing device 20 is for installing an awning 1 at a desired location on an installation wall 8 which is a vertical surface.

In the example being described, the horizontal width of the wall 8 is described as being substantially equal to the length of the awning 1. Also, it is assumed that the left edge of the wall 8 connects a front edge of a left side wall 25 which extends perpendicularly forward to the wall 8. This type of corner is referred to an "outward" corner 26 in this specification.

Also, a right side wall 27 extends perpendicularly forward from the right end of the wall 8 to form a corner, which is referred to as "inward" corner 28 in the present specification.

Figure 9:
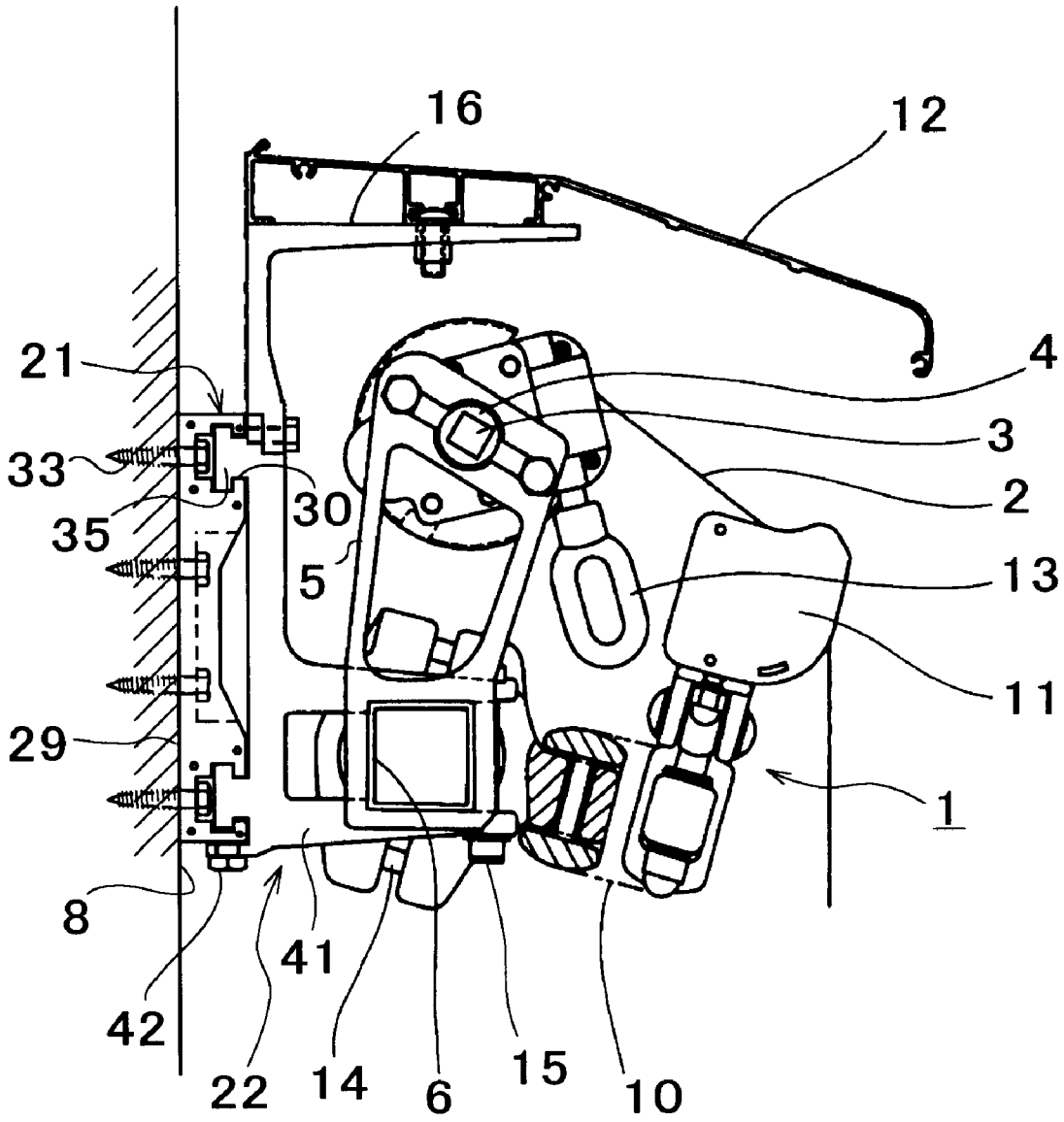
FIG. 9 is a schematic left side view of an awning installed onto a wall with the awning installing device according to the present invention, with a sunshade sheet rolled up.
Figure 10B:
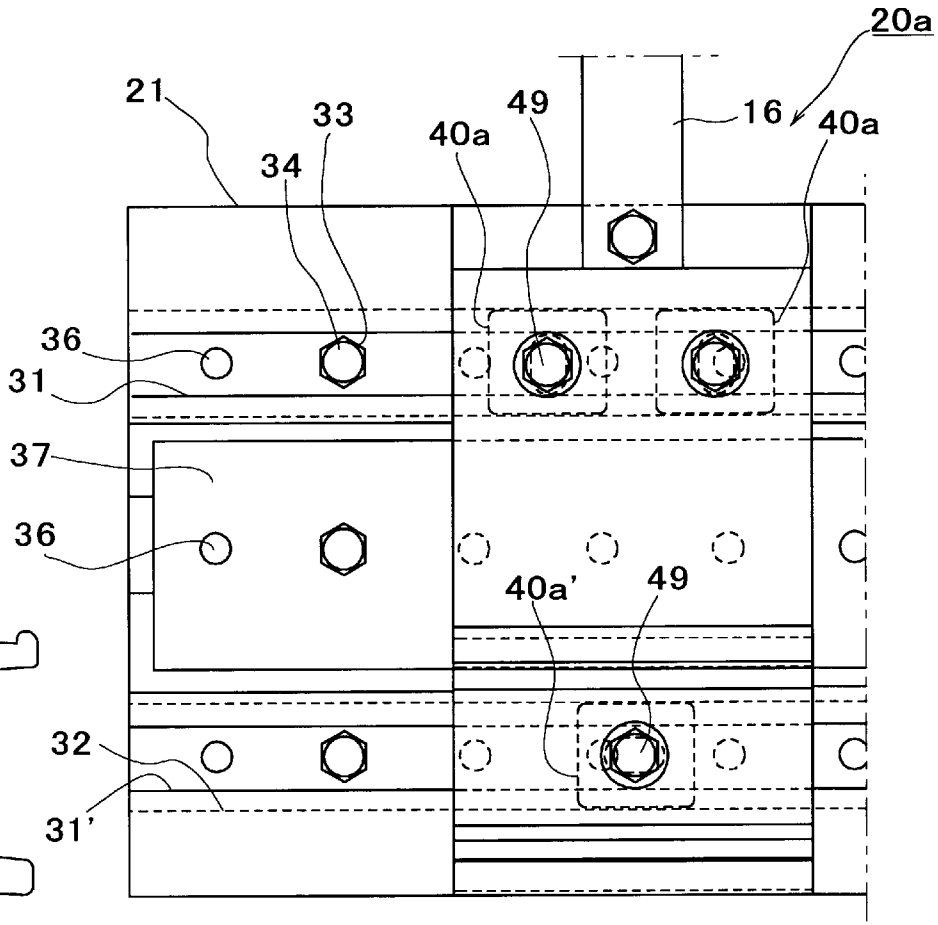
Figure 10A:
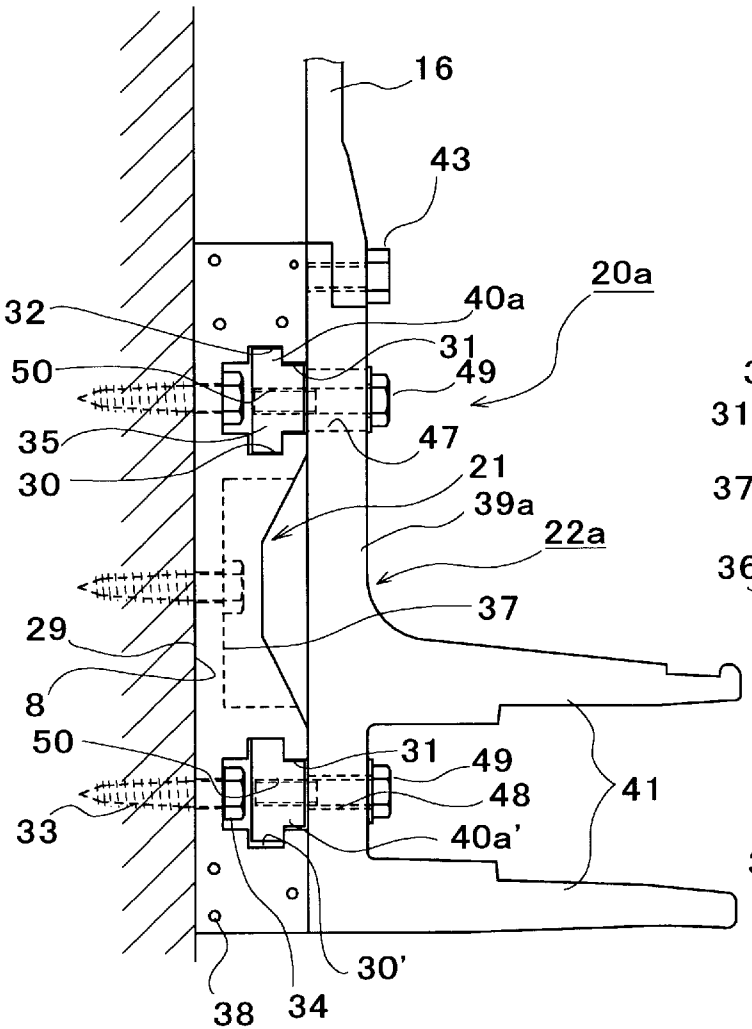

As shown in FIGS. 2 and 9, the awning 1 is the same as or similar to the one described with reference to the prior art installing device. The two brackets 22 are used to hold and support the rectangular shaft 6 at portions near the opposite ends of the shaft 6 whereby the awning 1 can be installed on the wall 8 at a desired location. As described previously, the sunshade sheet 2 is shown as being transparent in order to show the structures under it, but, needless to say, it actually shields things beneath it from the sunlight.

Figure 3A:
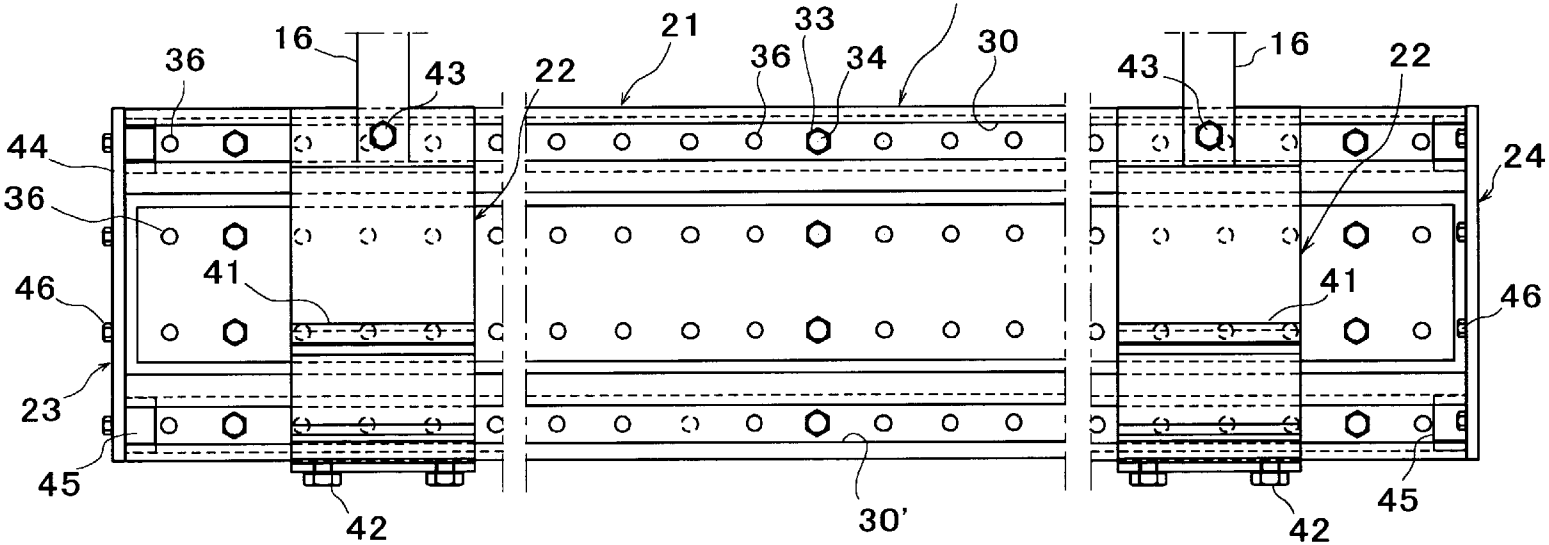
FIGS. 3A and 3B are partial front and plan views of the awning installing device according to the first embodiment.
Figure 3B:
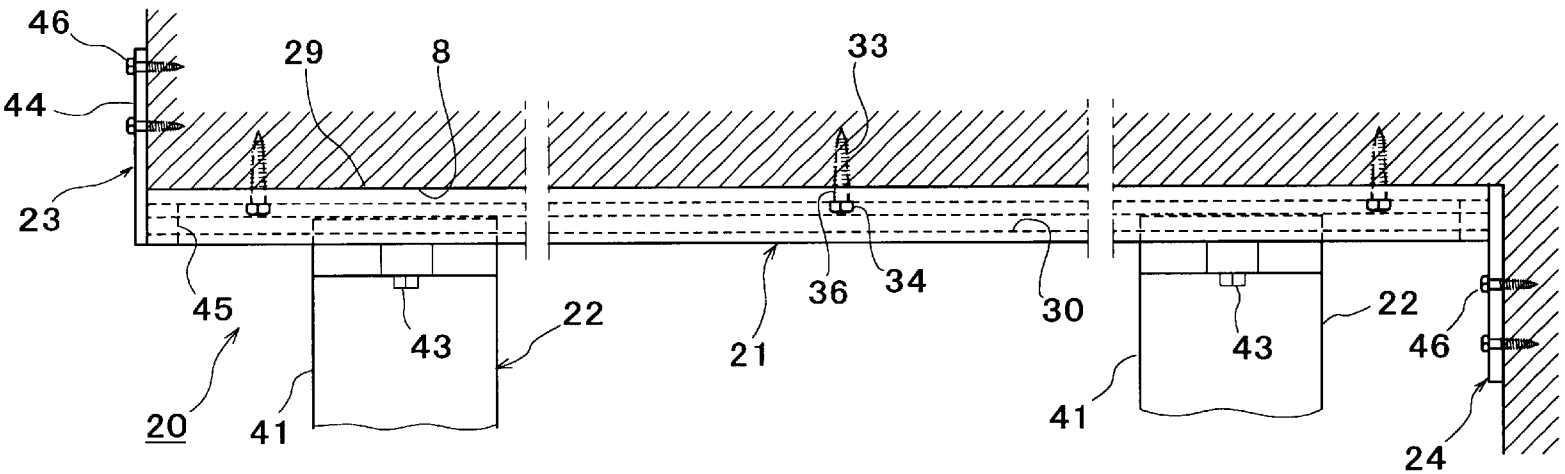
Figure 4B:
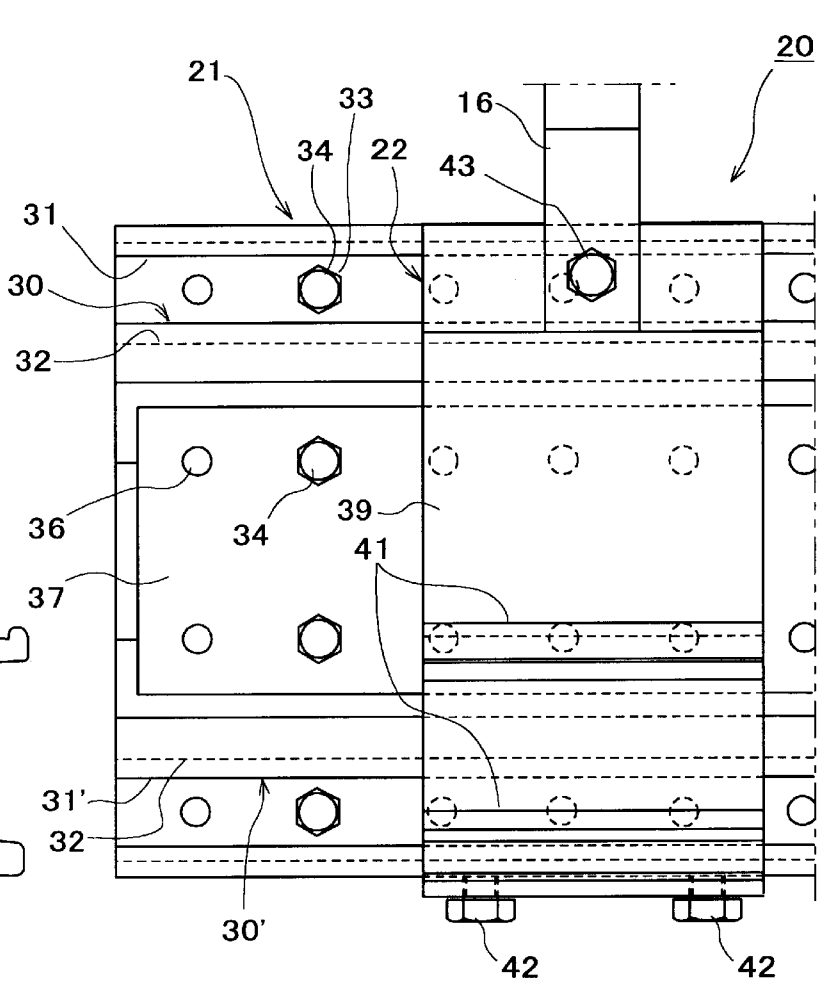
FIGS. 4A and 4B are enlarged side and front views of part of the device shown in FIGS. 3A and 3B, with an end securing member removed.
Figure 4A:
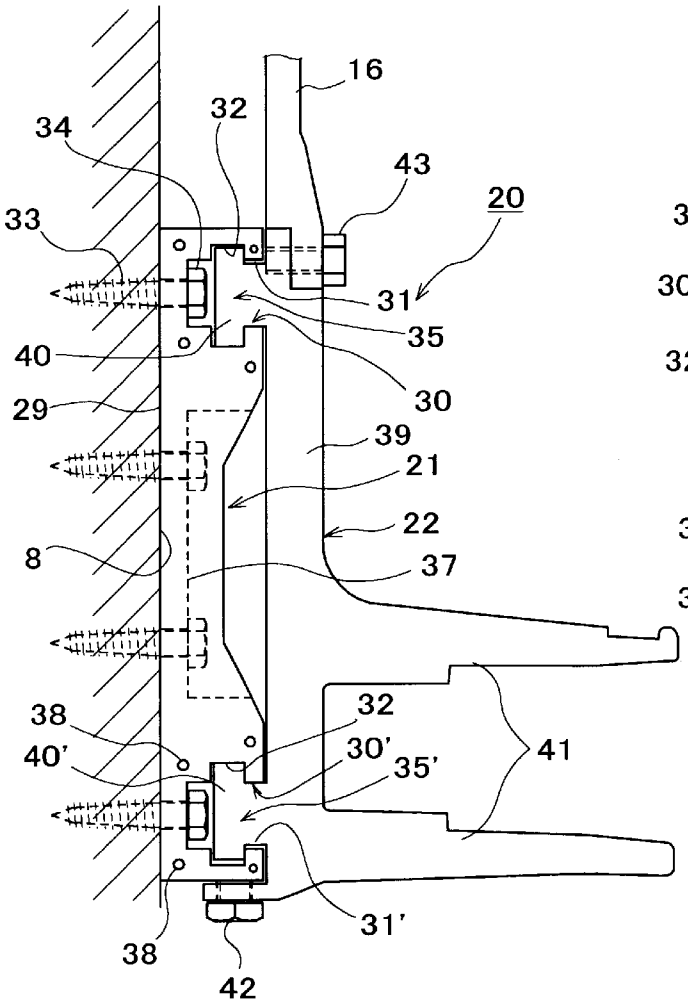

As shown in FIGS. 3A, 3B, 4A and 4B, the main body 21 may be cast from, for example, aluminum or aluminum alloy, and is formed in the generally plate-like shape having a given width and appropriate thickness and length. One of two major surfaces of the main body 21, i.e. the rear surface 29 shown, for example, in FIG. 3B, is placed to face the wall 8 and may be sometimes referred to as "installation surface" in this specification. The other one of the major surfaces, that is, the front surface may be sometimes referred to as "awning mounting surface" in this specification. In the awning mounting surface, two grooves 31 and 31' are formed to longitudinally extend along the entire length of the main body 21, and act as a guide 30. Each of the grooves 31 and 31' has a cross-shaped transverse cross-section as shown in FIG. 4A. In other words, each of the grooves 31 and 31' includes an elongated straight groove having parallel side walls and a bottom perpendicular to the side walls, and intermediate enlarged portion 32 extending outward from the respective side walls of the straight groove. The shape and size of the bottom portion of each of the grooves 31 and 31', which is narrower than the intermediate enlarged portion 32 and of the same width as a top or opening portion of the groove 31 (31'), is determined such that the head 34 of a securing screw 33 seated thereon does not interfere with a guided portion 35 (35'), which will be described later.

The main body 21 is provided with a number of holes 36 extending through the thickness of the body 21. Appropriate ones of the holes 36 are selected to secure the main body 21 to the wall 8. For example, four holes 36 are formed in a row extending across the width of the main body 21, and a plurality of such rows of holes 36 are arranged at appropriate intervals along the length of the main body 21. The holes 36 at the opposite ends of each row extend through the bottoms of the respective grooves 31 and 31', while the remaining intermediate holes 36 are formed to extend through the bottom of a recess 37. The recess 37 is formed in the front surface of the main body 21 to a depth similar to that of the grooves 31 and 31'.

The main body 21 may be a single unit having a length necessary for one awning. Alternatively, shorter members having a length of, for example, a submultiple of the length of an ordinary awning may be prepared, and a plurality of such shorter members may be connected to provide a main body 21 having a required length. In such case, some pin holes 38 may be formed in mating side surfaces of the main body members at corresponding locations so that, when they are connected, pins placed in pin holes 38 (FIG. 4) formed in both end surfaces of the shorter body members at the corresponding locations can be used to properly position the members.

As a still further alternative, a longer main body may be cut to a length appropriate for securing the awning to the wall 8.

As shown in FIGS. 3A, 3B, 4A and 4B, each of the brackets 22 has a rectangular base plate 39 elongated in the direction of the width of the main body 21. The base 39 extends over the front side of the main body 21. Also, each bracket 22 has two groove engagement sections 40 and 40' which extend backward from the opposite ends of the base 39 and are in engagement with the respective ones of the grooves 31 and 31' acting as the guides 30 and 30'. The groove engagement sections 40 and 40' act as the guided portions 35 and 35'. The engagement sections 40 and 40' extend along the entire length (the dimension along the length of the main body 21) of the base 39 and backward toward the grooves 31 and 31'. Each of the groove engagement sections 40 and 40' has an enlarged portion which fit into the enlarged portion 32 in the corresponding one of the grooves. From the lower portion of the base 39, a pair of jaw-like members 41 extend forward. The rectangular shaft 6 of the awning 1 is inserted and clamped between the jaws 41 by tightening a bolt 15 (FIG. 9).

The brackets 22 are mounted on the main body 21 by inserting the enlarged portions of the groove engagement sections 40 and 40' into the corresponding enlarged portions 32 of the grooves 31 and 31' from ends of the respective grooves. The brackets 22 are then moved to desired locations along the main body 21 and fixed there by means of bolts 42.

Bolts 43 shown in FIGS. 3A, 3B, 4A and 4B are used to fix the L-shaped arms 16 which support the awning roof 12.

Figure 5A:
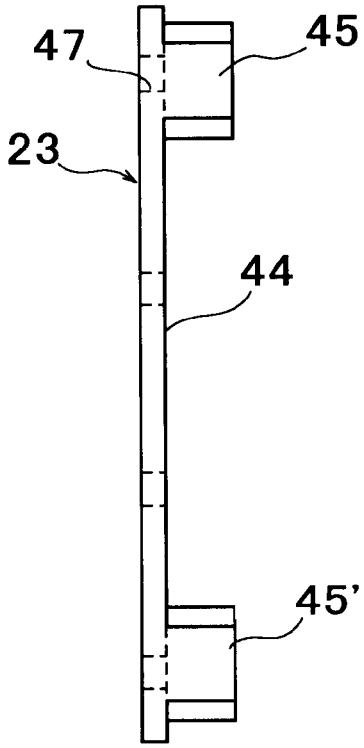
FIGS. 5A, 5B and 5C are front, right side and plan views of an end securing member for securing the left end of the main body of the awning installing device to a wall which is perpendicular to the main wall to which the main body is secured and which forms an "outward" corner with the main wall.
Figure 5B:
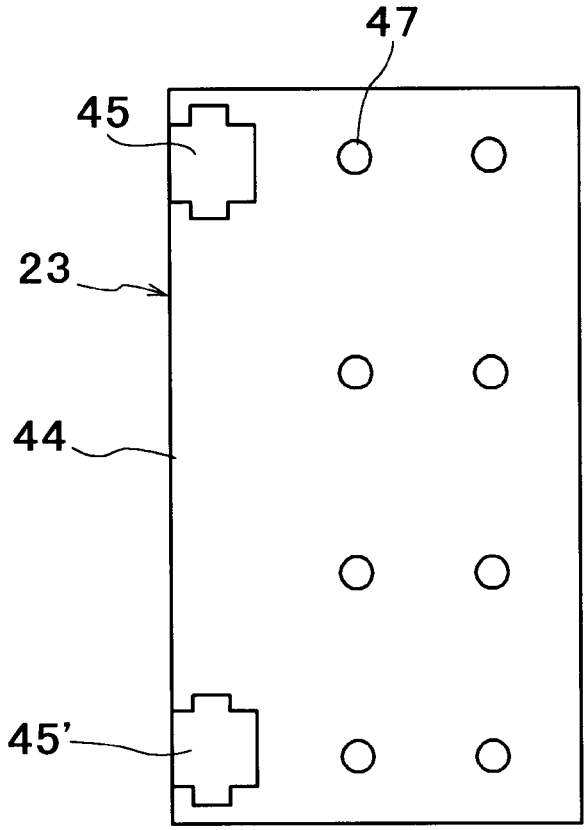
Figure 5C:
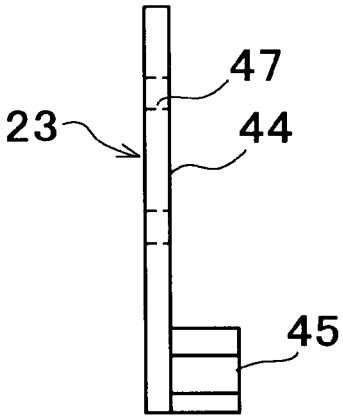

The end securing members 23 and 24 are of cast metal similar to the main body 21. As shown in FIGS. 5A, 5B and 5C, the left end securing member 23 includes a rectangular plate 44, and upper and lower projections 45 and 45' projecting from the right side surface of the plate 44 at the locations corresponding to the locations of the grooves 31 and 31', respectively, in the main body 21. The projections 45 and 45' have a cross-section conformable to the cross-section of the grooves 31 and 31' so that they can be inserted into the grooves from the respective left ends. The left end securing member 23 further includes plural, e.g. eight, screw holes 47 through which screws 46 are screwed to secure the plate 44 to the wall 25 (FIG. 2). As is seen from FIG. 3B and FIGS. 5A–5C, the front edge of the plate 44 are in line with the front edges of the projections 45 and 45'.

Figure 6A:
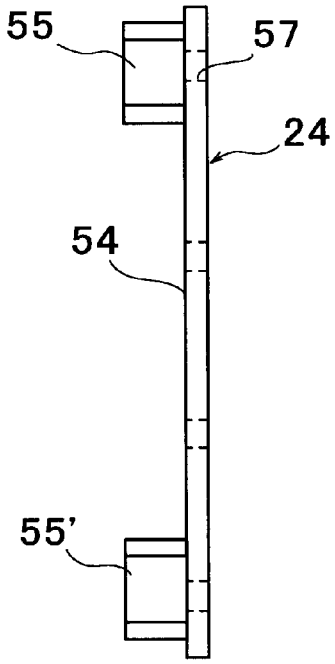
FIGS. 6A, 6B and 6C are front, left side and plan views of an end securing member for securing the right end of the main body of the awning installing device to a wall which is perpendicular to the main wall to which the main body is secured and which forms an "inward" corner with the main wall.
Figure 6B:
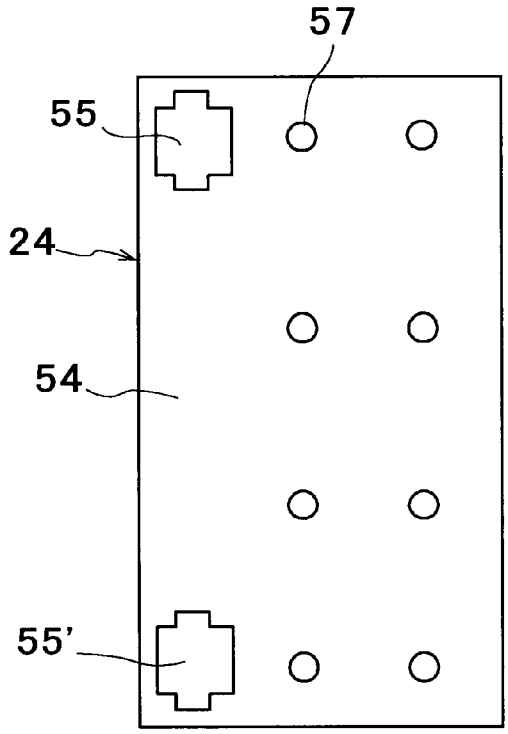
Figure 6C:
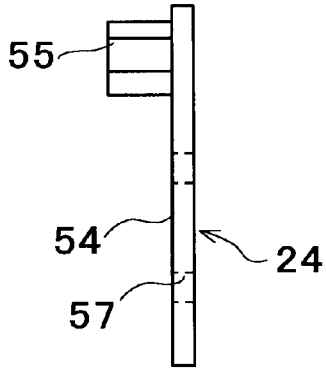

The right end securing member 24, as shown in FIGS. 6A, 6B and 6C, has a similar structure to the member 23. Projections 55 and 55' similar to the projections 45 and 45' project from the left side surface of a plate 54 similar to the plate 44 and have a cross-section conformable to that of the grooves 31 and 31' so that they can be inserted into the grooves from the respective right ends. Different from the left end securing member 24, which has the projections 45 and 45' formed at locations along the front edge of the plate 44, the projections 55 and 55' of the member 24 are formed near to the rear edge of the plate 54 at locations offset inward of the rear edge of the plate 54 by the thickness of the bottoms of the grooves 31 and 31'. A plurality of screw holes 57 similar to the holes 47 in the left end securing member 23 are formed through the plate 54 for firmly securing the right end securing member 24 to the wall 27 forming the "inward" corner 28 (FIG. 2) without leaving a space as shown in FIG. 3B.

Figure 7A:
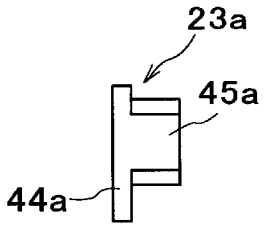
Figure 7B:
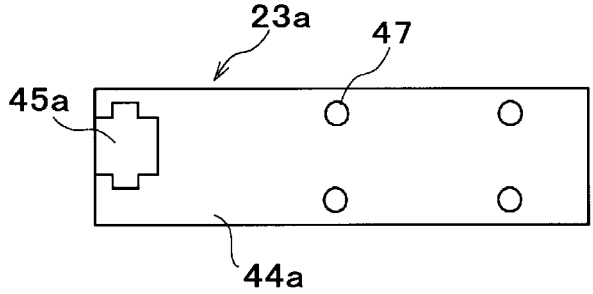
Figure 7C:
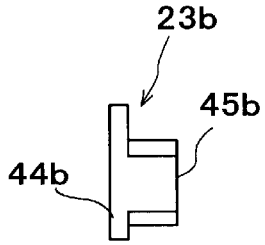
Figure 7D:
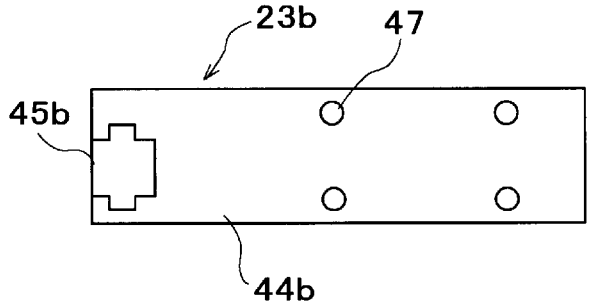

FIGS. 7A through 7D and FIGS. 8A through 8D show different forms of the left and right end securing members 23 and 24, respectively. The securing members 23 and 24 are formed of two parts 23*a* and 23*b*, and 24*a* and 24*b*, respectively. FIGS. 7A and 7B are front and right side views of an upper left securing member part 23*a*, and FIGS. 7C and 7D are front and right side views of a lower left securing member part 23*b*. The upper and lower member parts 23*a* and 23*b* are formed respectively of plates 44*a* and 44*b*, and projections 45*a* and 45*b*. Screw holes 47 are formed in the respective plates 44*a* and 44*b*.

Figure 8A:
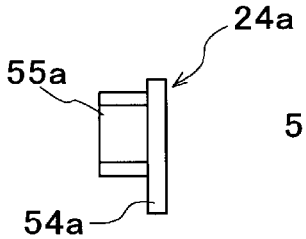
Figure 8B:
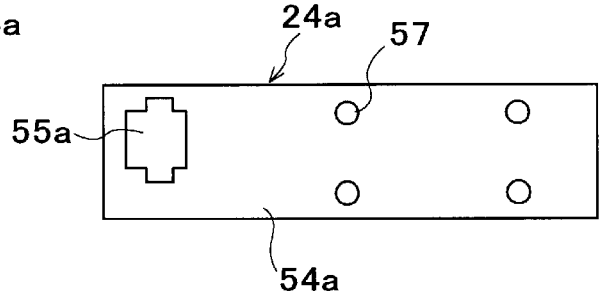
Figure 8C:
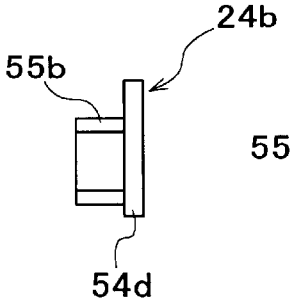
Figure 8D:
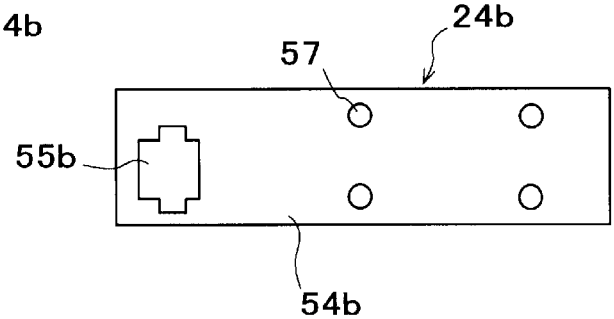

FIGS. 8A and 8B are front and left side views of an upper right securing member part 24*a*, and FIGS. 8C and 8D are front and left side views of a lower right securing member part 24*b*. The upper and lower member parts 24*a* and 24*b* are formed respectively of plates 54*a* and 54*b*, and projections 55*a* and 55*b*. Screw holes 57 are formed in the respective plates 54*a* and 54*b*.

Which forms of the end securing members should be used can be determined, taking into account necessary conditions, such as the appearance and the strength required.

Although not shown, if the "outward" and "inward" corners are on the right and left hand sides, respectively, opposite to the showing in FIG. 2, the left end securing member to be used should have a symmetric configuration with respect to the one shown in FIGS. 5A through 5C or FIGS. 7A through 7D, and the right end securing member should have a symmetric configuration with respect to the one shown in FIGS. 6A through 6C or FIGS. 8A through 8D.

The awning 1 can be installed on the wall 8, as shown in FIG. 2, by means of the awning installing device 20 described above. First, the right end securing member 24 is fixed to the right side wall 27 (FIG. 2) with the screws 46. Then, the main body 21 is positioned in such a manner that the projections 55 and 55' of the right end securing member 24 can enter into the right end openings of the grooves 31 and 31' of the main body 21. Thereafter, the main body 21 is fixed to the wall 8 with the screws 33. Then, the groove engagement sections 40 and 40' of each of the two brackets 22 are slid into the grooves 31 and 31' through the left end openings of the grooves.

After that, the projections 45 and 45' of the left end securing member 23 are fitted into the left end openings of the grooves 31 and 31', and, the member 23 is fixed to the wall 25 (FIG. 2) by means of the screws 46. In this stage, the brackets 22 can slide along the grooves 31 and 31' which act as the guides 30 and 30'. The brackets 22 are moved along the grooves 31 and 31' to respective appropriate locations for supporting the awning 1, and fixed to the main body 1 at the respective locations by fastening the screws 42.

After that, the awning 1 is mounted on the awning installing device 20 by securing it to the jaws 41 of the respective brackets 22 by means of the bolts 15 and other suitable means.

The awning 1 installed on the wall 8 in the manner as above described is shown in FIGS. 2 and 9. In FIG. 2, the sunshade sheet 2 is rolled out, whereas it is shown rolled up in FIG. 9.

An awning installing device 20*a* according to a second embodiment of the invention is described with reference to FIGS. 10A and 10B and FIGS. 11A, 11B and 11C.

The awning installing device 20*a* differs from the awning installing device 20 according to the first embodiment, in the structure of the groove engagement sections of the brackets. The remaining structure is substantially the same as the first embodiment. Accordingly, the same reference numerals are attached to the same or similar components, and their detailed description is not made.

Figure 11A:
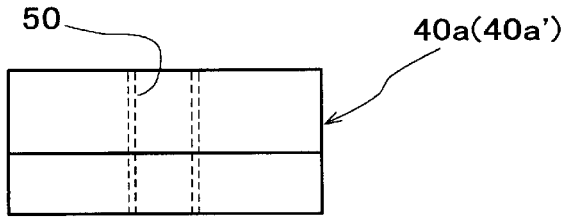
Figure 11B:
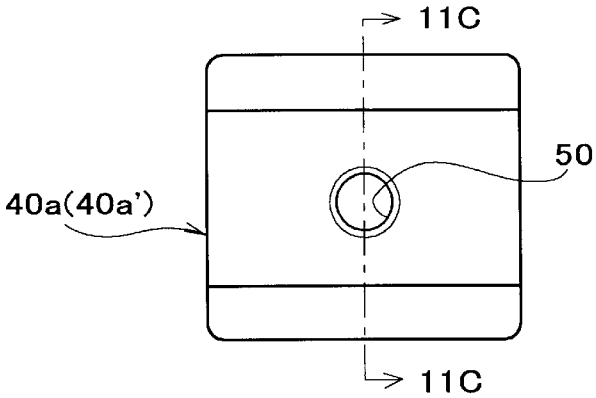
Figure 11C:
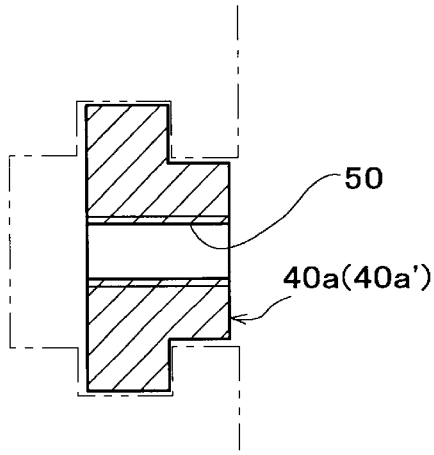

According to the second embodiment, the groove engagement sections 40 and 40' employed for each bracket 22 in the first embodiment are replaced by two groove engagement members 40*a* and one groove engagement member 40*a'* for each bracket 22*a*, which are formed as separate members from the base 39*a* and the jaws 41. As shown in FIG. 11C, each of the groove engagement members 40*a* and 40*a*' has a transverse cross-section along the line 11C—11C in FIG. 11B, which is same as that of the groove engagement sections 40 and 40' of the first example shown in FIGS. 3A, 3B, 4A and 4B. However, as shown in FIGS. 11A and 11B, they have a shorter dimension along the groove than the sections 40 and 40' of the first example. Each of the groove engagement members 40*a* and 40*a*' is in the shape of shouldered rectangular nut with a screw hole 50 at its center.

Two screw holes 47 are provided through the bracket 22*a* at locations corresponding to the groove 31, and one screw hole 48 is formed through the bracket 22*a* at a location corresponding to the groove 31'. The screw holes 47 have a vertically elliptical transverse cross-section, while the screw hole 48 has a horizontally elliptical transverse cross-section. The groove engagement members 40*a* and 40*a*' in the grooves 31 and 31' are coupled to the bracket 22*a* by screwing male screws 49 into the screw holes 47 and 48 and the screw holes 50 in the groove engagement members 40*a* and 40*a*', as shown in FIGS. 11A and 11B. Tightening the screws 49 can firmly couple the groove engagement members 40*a* and 40*a*' with the bracket 22*a* and, hence, the main body 21. By loosening the screws 49, the bracket 22 with the groove engagement members 40*a* and 40*a*' loosely coupled to it can move along the grooves 31 and 31'. In other words, the groove engagement members 40*a* and 40*a*' of this embodiment acts both as the guided portions of the bracket 22 and as the bracket securing means.

Since the manner of mounting the awning 1 with the awning installing device 20*a* of the second embodiment is the same as described above with reference to the first embodiment, no further description about the mounting of the awning 1 to the wall 8 is given.

In the above-described arrangements, the both ends of the grooves and, hence, the both ends of the main body of the awning installing device are secured to the walls by means of the end securing members. However, either or both of the end securing members may be eliminated, depending on the circumstances where the awning is installed.

Also, the holes 36 for securing the main body 21 to the wall 8 with the screws 33 may be eliminated and formed in situ. However, it is preferable to provide the main body 21 with the holes 36 beforehand so that the working to provide holes 36 in situ can be eliminated to thereby shorten the time necessary for installing the awning 1.

Also, anchor bolts or any other means compatible with for the material used for the wall 8 may be used in place of the screws 33 for securing the awning installing device 20 or 20*a*.

What is claimed is:

1. An awning installing device comprising:

a generally plate-shaped main body having a given width and a thickness and a length, said main body having first and second opposing major surfaces, said first major surface being adapted to be secured to a structure onto which an awning is to be installed, said awning being adapted to be mounted on said second major surface, said main body being provided with two parallel guides spaced apart from each other in the width direction of said main body, said two guides extending along the entire length of said main body; and a bracket for supporting said awning, said bracket having two guided portions to be guided along respective ones of said two guides of said main body so that said bracket can be moved along said guide to a desired location along said main body where said bracket can be secured to said main body.

2. The awning installing device according to claim 1 wherein each guide comprises a groove formed in said main body to extend along the length of said main body, and each guided portion of said bracket is formed in groove engagement means of said bracket which is located within and engages with said groove in such a manner that load exerted to said bracket can be borne.

3. The awning installing device according to claim 1 wherein said main body is provided with a plurality of holes extending therethrough, selected ones of said holes being useable for securing said main body to said structure.

4. The awning installing device according to claim 2 wherein said main body is provided with a plurality of holes extending therethrough, selected one of said holes being useable for securing said main body to said structure.

5. The awning installing device according to claim 2 wherein:

each groove opens at said second major surface;

each groove engagement means comprises a groove engagement member formed as a unit separate from said bracket; and each groove engagement member and said bracket are coupled together by means of a screw.

6. The awning installing device according to claim 4 wherein:

each groove opens at said second major surface;

each groove engagement means comprises a groove engagement member formed as a unit separate from said bracket; and each groove engagement member and said bracket are coupled together by means of a screw.

7. The awning installing device according to claim 4 wherein:

each groove opens at said second major surface;

each groove engagement means comprises a groove engagement member formed as a unit separate from said bracket; and each groove engagement member and said bracket are coupled together by means of a screw.

8. The awning installing device according to claim 2 further comprising an end securing member for securing an end of said main body, said end securing member comprising a plate having first and second opposing major surfaces, two projections projecting from said first major surface of said plate and each being adapted to be fitted into an opening of each groove at said end, and an extension continuous to said plate, said extension extending either in the direction toward said structure or in the opposite direction, whereby said end securing member can be secured to a wall extending generally perpendicularly to said structure.

9. The awning installing device according to claim 5 further comprising an end securing member for securing an end of said main body, said end securing member comprising a plate having first and second opposing major surfaces, two projections projecting from said first major surface of said plate and each being adapted to be fitted into an opening of each groove at said end, and an extension continuous to said plate, said extension extending either in the direction toward said structure or in the opposite direction, whereby said end securing member can be secured to a wall extending generally perpendicularly to said structure.

10. The awning installing device according to claim 6 further comprising an end securing member for securing an end of said main body, said end securing member comprising a plate having first and second opposing major surfaces, two projections projecting from said first major surface of said plate and each being adapted to be fitted into an opening of each groove at said end, and an extension continuous to said plate, said extension extending either in the direction toward said structure or in the opposite direction, whereby said end securing member can be secured to a wall extending generally perpendicularly to said structure.

11. The awning installing device according to claim 7 further comprising an end securing member for securing an end of said main body, said end securing member comprising a plate having first and second opposing major surfaces, two projections projecting from said first major surface of said plate and each being adapted to be fitted into an opening of each groove at said end, and an extension continuous to said plate, said extension extending either in the direction toward said structure or in the opposite direction, whereby said end securing member can be secured to a wall extending generally perpendicularly to said structure.

* * * * *